US011359899B2

(12) United States Patent
Lee et al.

(10) Patent No.: US 11,359,899 B2
(45) Date of Patent: Jun. 14, 2022

(54) ELECTRONIC DETONATION DEVICE FOR BLASTING SYSTEM AND BLASTING SYSTEM USING SAME

(71) Applicant: HANWHA CORPORATION, Seoul (KR)

(72) Inventors: Doo Hyun Lee, Boeun-gun (KR); Ki Won Hwang, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 240 days.

(21) Appl. No.: 16/627,673

(22) PCT Filed: Dec. 12, 2019

(86) PCT No.: PCT/KR2019/017626
§ 371 (c)(1),
(2) Date: Dec. 30, 2019

(87) PCT Pub. No.: WO2020/130492
PCT Pub. Date: Jun. 25, 2020

(65) Prior Publication Data

US 2021/0364264 A1 Nov. 25, 2021

(30) Foreign Application Priority Data

Dec. 19, 2018 (KR) ..... 10-2018-0165399

(51) Int. Cl.
*F42D 1/05* (2006.01)
*F23Q 21/00* (2006.01)

(52) U.S. Cl.
CPC ..... *F42D 1/05* (2013.01); *F23Q 21/00* (2013.01)

(58) Field of Classification Search
CPC ..... F42D 1/05; F23Q 21/00
USPC ..... 361/248
See application file for complete search history.

(56) References Cited

U.S. PATENT DOCUMENTS

2003/0070572 A1 4/2003 Tang
2005/0016370 A1* 1/2005 O'Brien ..... F42D 1/043 86/1.1
2005/0103219 A1* 5/2005 McClure ..... F42D 1/055 102/311

(Continued)

FOREIGN PATENT DOCUMENTS

JP 2013-19605 A 1/2013
WO 2017/181207 A1 10/2017
WO WO-2017181207 A1 * 10/2017 ..... B65H 49/32

*Primary Examiner* — Yemane Mehari
(74) *Attorney, Agent, or Firm* — WHDA, LLP

(57) ABSTRACT

The present disclosure relates to an electronic detonation device for a blasting system. The electronic detonation device include: an electronic detonator; a wireless communication module; an electric wire connecting the electronic detonator to the wireless communication module; and a communication module support in which the electric wire is stored in a wound state, with the wireless communication module positioned on an upper surface of the communication module support. The communication module support is provided with a pile part configured to be driven into a ground for fixation, so that the electronic detonation device enables stable communication reliability to be secured by orienting the wireless communication module toward the sky, thereby preventing malfunction during blasting and improving blasting accuracy.

12 Claims, 9 Drawing Sheets

(56) References Cited

U.S. PATENT DOCUMENTS

| | | | | |
|---|---|---|---|---|
| 2012/0255455 | A1 | 10/2012 | Risner et al. | |
| 2014/0123866 | A1* | 5/2014 | Givens | F42B 3/10<br>102/312 |
| 2016/0273902 | A1 | 9/2016 | Eitschberger | |

* cited by examiner

ELECTRONIC DETONATION DEVICE FOR BLASTING SYSTEM AND BLASTING SYSTEM USING SAME

TECHNICAL FIELD

The present disclosure relates to an electronic detonation device for a blasting system and a blasting system using the same. More particularly, the present disclosure relates to an electronic detonation device for a blasting system, the electronic detonation device enabling stable communication reliability to be secured by orienting a wireless communication module toward the sky, and a blasting system using the electronic detonation device.

BACKGROUND ART

In general, explosives are used in engineering work, such as rock blasting for tunnel construction and building demolition. In particular, a plurality of holes, into which explosives are to be inserted, is drilled corresponding to the sections of a blasting target, i.e. the object to be blasted. After an explosive is inserted into each of the drilled holes, the explosives are connected to a user terminal. The explosives are exploded by operating the user terminal, thereby blasting the blasting target.

As a detonation device for exploding explosives, a wireless-communication-type detonation device or a wired-communication-type detonation device may be used.

Conventionally, an electronic detonation device using wireless communication cannot be used in a wired blasting system, and an electronic detonation device using wired communication cannot be used in a wireless blasting system. Accordingly, there have been problems of inconvenient work and increased costs.

In case of the electronic detonation device using wireless communication, a wireless communication module is preferably oriented toward the sky, but a separate support is used to fix the position of the wireless communication module after installation of the electronic detonation device.

When the position of the wireless communication module is fixed using the separate support, a support that is suitable for the wireless communication module has to be manufactured separately, resulting in additional cost related to the support. Further, installing the support separately on the ground and mounting the wireless communication module on the installed support is troublesome.

DISCLOSURE

Technical Problem

Accordingly, the present disclosure has been made keeping in mind the above problems occurring in the prior art, and an objective of the present disclosure is to provide an electronic detonation device for a blasting system, the electronic detonation device enabling stable communication reliability to be secured by orienting a wireless communication module toward the sky, and a blasting system using the electronic detonation device.

Another objective of the present disclosure is to provide an electronic detonation device for a blasting system, the electronic detonation device communicating with a user terminal by selectively using wireless communication or wired communication, and a blasting system using the electronic detonation device.

A further objective of the present disclosure is to provide an electronic detonation device for a blasting system, the electronic detonation device enabling improved operation convenience and reduced operation expenses, and a blasting system using the electronic detonation device.

Technical Solution

In order to accomplish the above object, the present disclosure provides an electronic detonation device for a blasting system including: an electronic detonator; a wireless communication module; an electric wire connecting the electronic detonator to the wireless communication module; and a communication module support in which the electric wire is stored in a wound state, with the wireless communication module positioned on an upper surface of the communication module support, wherein the communication module support may be provided with a pile part configured to be driven into a ground for fixation.

The communication module support may include: a wire-winding part on which the electric wire is wound; an upper panel part positioned above the wire-winding part, and on which the wireless communication module is positioned; and a lower panel part positioned under the wire-winding part.

The upper panel part may be provided with the pile part protruding downwards from a lower surface thereof, and the pile part may be positioned to be removably coupled to the wire-winding part.

The pile part may be forcibly fitted into the wire-winding part.

The pile part may be coupled into the wire-winding pail in a screwing manner.

The pile part may be inserted into the wire-winding part, and may be fixed while being coupled to the wire-winding part such that an outer circumferential surface of the pile part may be pressed by a set screw tightened to the wire-winding part.

The communication module support may have a hollow part open at upper and lower ends thereof, and the pile part may be positioned inside the hollow part to be moveable upwards and downwards so that the pile part selectively may protrude through a lower portion of the communication module support and may be then fixed into the ground.

The pile part may be positioned inside the hollow part in a screwing manner, and may be rotated by a rotating device so as to selectively protrude through the lower portion of the communication module support and to be driven into the ground.

The communication module support may include: a wire-winding part on which the electric wire is wound; an upper panel part positioned above the wire-winding par, and on which the wireless communication module is positioned; and a lower panel part positioned under the wire-winding part, wherein the wire-winding part may have a hollow part open at upper and lower ends thereof, the pile part may be coupled into the hollow part in a screwing manner and be moved upwards and downwards depending on a direction of rotation thereof, and a lower surface of the lower panel may have an anti-rotation protrusion configured to prevent rotation thereof when the pile part is rotated by a rotating device.

The communication module support may have the hollow part open at the upper and lower ends thereof, the hollow part may be provided with a pile-supporting plate at a lower end thereof to support a lower end of the pile part, and the pile part may be moveable inside the hollow part and be driven into the ground when a hitting device hits the pile part.

The pile-supporting plate may have a plurality of cutting guide grooves therein, each of the cutting guide grooves being formed as a partial cut along a straight line, so that the pile-supporting plate may be tom when being pressed by the pile part.

The pile part may be provided on an outer circumferential surface thereof with a plurality of moving guide protrusions formed to be spaced apart from each other in a circumferential direction thereof, so that the pile part may descend straight by being guided by the moving guide protrusions, and the hollow part may have moving guide rails on an inner circumferential surface thereof, so that the moving guide protrusions may be inserted into the hollow part to be moveable along the moving guide rails and may descend by being guided by the moving guide rails.

The moving guide rails may be blocked at upper ends thereof to limit the pile part from being moved upwards from the hollow part, and the moving guide rails may be blocked at lower ends thereof to limit a downward protruding length of the pile part and to prevent the pile part from being removed downwards from the hollow part when the hitting device hits the pile part.

Further, the electronic detonation device may include: a wired connector connecting the electric wire to a user terminal in a wired manner; and a blast control wire electrically connecting the wired connector to the user terminal.

In order to accomplish the above object, the present disclosure provides a blasting system, the blasting system may include: an electronic detonator; a wireless communication module; an electric wire connecting the electronic detonator to the wireless communication module; a user terminal communicating wirelessly with the electronic detonator using the wireless communication module to control operation of the electronic detonator; a wired connector connecting the electric wire to the user terminal in a wired manner; and a blast control wire electrically connecting the wired connector to the user terminal.

Further, the blasting system may include: a communication module support in which the electric wire is stored in a wound state, the wireless communication module being positioned on an upper surface of the communication module support, wherein the communication module support may be provided with a pile part configured to be driven into the ground for fixation, so that the wireless communication module may be oriented in a vertical direction toward a sky.

The user terminal may include: a time-setting module setting a detonation time corresponding to the electronic detonator; a positioning module checking a position of the electronic detonator; an identification module detecting an identifier through wired communication or wireless communication with the electronic detonator; and a delay-time-setting module setting a blast delay time corresponding to the electronic detonator.

When the user terminal is synchronized with the electronic detonator, the time-setting module may set the detonation time corresponding to the electronic detonator and may transmit detonation time information to the electronic detonator.

When the user terminal is synchronized with the electronic detonator, the delay-time-setting module may set the blast delay time corresponding to the electronic detonator.

When the user terminal is synchronized with the electronic detonator, the positioning module may receive positioning information from the electronic detonator and the identification module may receive identifier information from the electronic detonator.

Advantageous Effects

As described above, the present disclosure is configured to secure stable communication reliability by orienting the wireless communication module toward the sky, so that malfunction during blasting can be prevented and blasting accuracy can be improved.

The present disclosure is configured to communication with the user terminal by selectively using wireless communication or wired communication, so that operation convenience can be improved and operation expenses can be reduced.

DESCRIPTION OF REFERENCE NUMERALS

Figure 1:
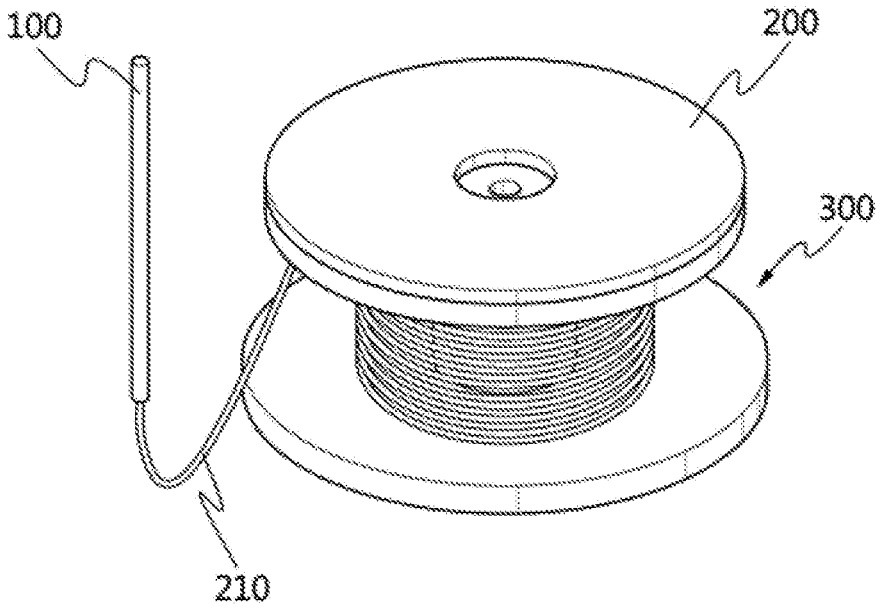
FIG. 1 is a perspective view showing a first embodiment of an electronic detonation device for a blasting system according to the present disclosure.

100: electronic detonator
200: wireless communication module
210: electric wire
300: communication module support
301: pile part
301*a*: rotating device
302: hollow part
310: wire-winding part
320: upper panel part
330: lower panel part
331: anti-rotation protrusion
340: pile-supporting plate
341: cutting guide grooves
350: moving guide protrusion
351: moving guide rail
400: wired connector
410: blast control wire
500: user terminal

BEST MODE

Hereinafter, the present disclosure will be described in more detail.

Exemplary embodiments of the present disclosure will be described in detail with reference to the accompanying drawings as follows. Prior to the detailed description of the present disclosure, all terms or words used in the description and claims should not be interpreted as being limited merely to common and dictionary meanings. Meanwhile, the embodiments described in the specification and the configurations illustrated in the drawings are merely examples, and do not exhaustively present the technical spirit of the present disclosure. Accordingly, it should be appreciated that there may be various equivalents and modifications that can replace the embodiments and the configurations at the time at which the present application is filed.

Figure 2:
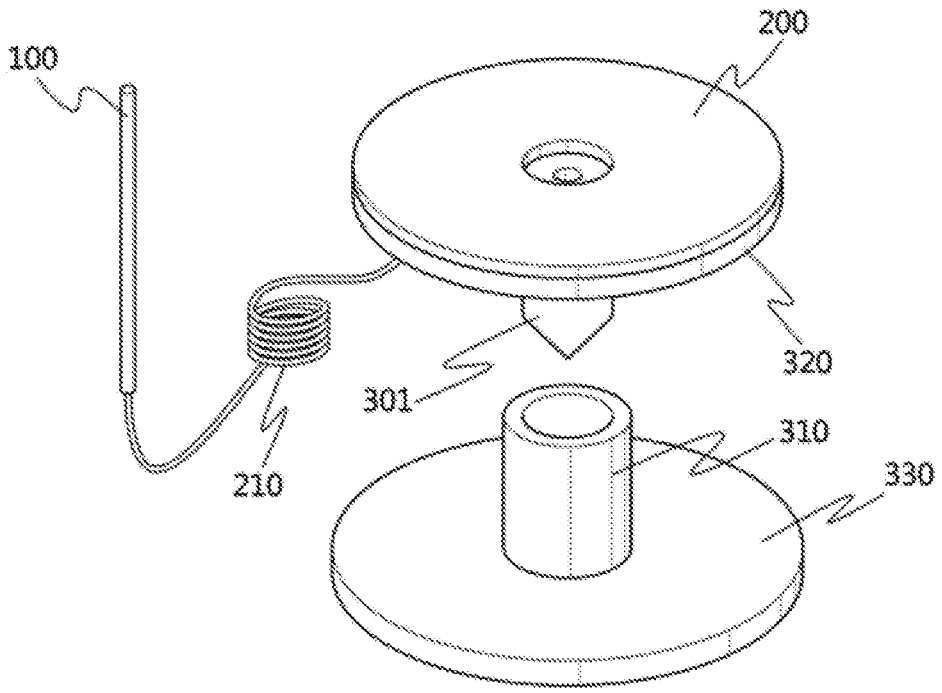
FIG. 2 is an exploded perspective view showing the first embodiment of the electronic detonation device for a blasting system according to the present disclosure.

FIG. 1 is a perspective view showing a first embodiment of an electronic detonation device for a blasting system according to the present disclosure, and FIG. 2 is an exploded perspective view showing the first embodiment of the electronic detonation device for a blasting system according to the present disclosure.

Referring to FIGS. 1 and 2, the first embodiment of the electronic detonation device for a blasting system according to the present disclosure includes: an electronic detonator 100; a wireless communication module 200; and an electric wire 210 connecting the electronic detonator 100 to the wireless communication module 200.

The electronic detonator 100 stores detonator information, and detonates in response to a blast command so as to explode an explosive.

The wireless communication module 200 is positioned on an upper surface of the communication module support 300, in which the electric wire 210 may be stored in a wound state.

The electric wire 210 may be implemented as various shapes using known electric wires for communication, and a detailed description thereof will be omitted.

The communication module support 300 is formed in a bobbin shape to wind the electric wire 210 thereon, and the wireless communication module 200 is positioned at the upper surface of the communication module support 300.

In more detail, the communication module support 300 includes: a wire-winding part 310, around which the electric wire 210 is wound; an upper panel part 320, positioned above the wire-winding part 310, and on which the wireless communication module 200 is positioned; and a lower panel part 330 positioned under the wire-winding part 310.

The wire-winding part 310 is formed in a cylindrical shape to wind and store wires without damage, the upper panel part 320 is a circular panel having a larger diameter than the diameter of the wire-winding part 310, and the lower panel part 330 is a circular panel having a larger diameter than the diameter of the wire-winding part 310.

The wireless communication module 200 may be provided inside the upper panel part 320, and may be provided as a structure that is embedded in a disk-type casing like the upper panel part 320.

The upper panel part 320 has a pile part 301 protruding from the lower surface thereof, and the pile part 301 may be driven into the ground for fixation. The pile part 301 is positioned to be removably coupled to the wire-winding part 310.

As an example, the pile part 301 is coupled into the wire-winding part 310 in a force-fitting manner, and has a pointed lower end, so that the pile part 301 may be easily driven into the ground.

The pile part 301 is inserted into the wire-winding part 310, and may be coupled to the wire-winding part 310 to be fixed while the outer circumferential surface of the pile part 301 is pressed by a set screw (not shown) tightened to the wire-winding part 310.

The pile part 301 may be separated from the wire-winding part 310 by releasing the set screw. Further, the pile part 301 may be fixed by tightening the set screw at the time of insertion into the wire-winding part 310.

The pile part 301 is separated from the wire-winding part 310, is then made to protrude through a lower portion thereof, and is then fixed in the ground. Thus, the upper panel part 320 allows the upper surface of the wireless communication module 200 positioned on an upper surface thereof to be oriented toward the sky.

As the pile part 301 is fixed in the ground, the upper surface of the upper panel part 320 is oriented in a vertical direction toward the sky.

That is, as the pile part 301 is fixed in the ground, the wireless communication module 200 positioned on the upper panel part 320 may be vertically oriented toward the sky, which is advantageous from the aspect of communication performance.

Figure 3:
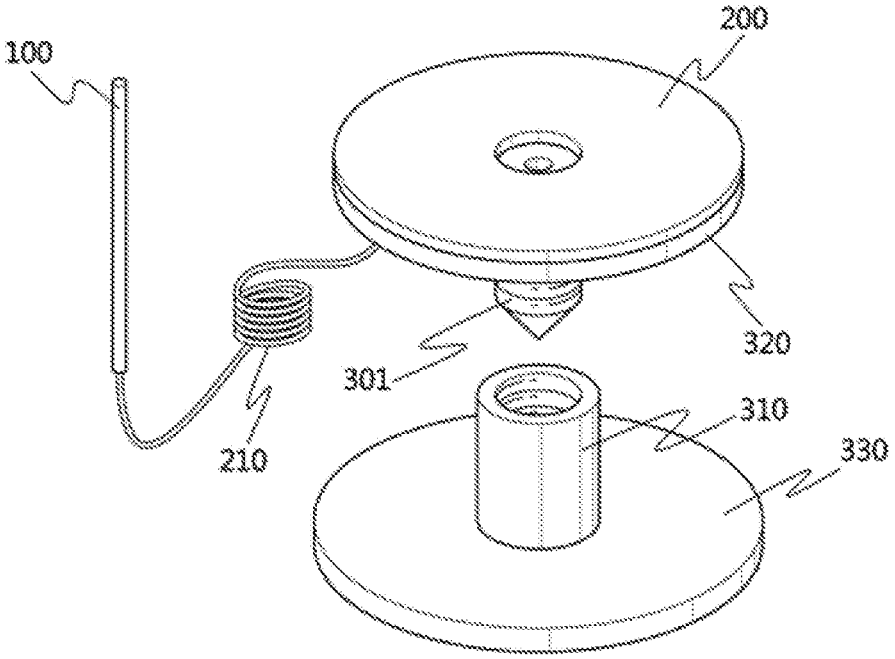
FIG. 3 is an exploded perspective view showing a second embodiment of the electronic detonation device for a blasting system according to the present disclosure.
Figure 4:
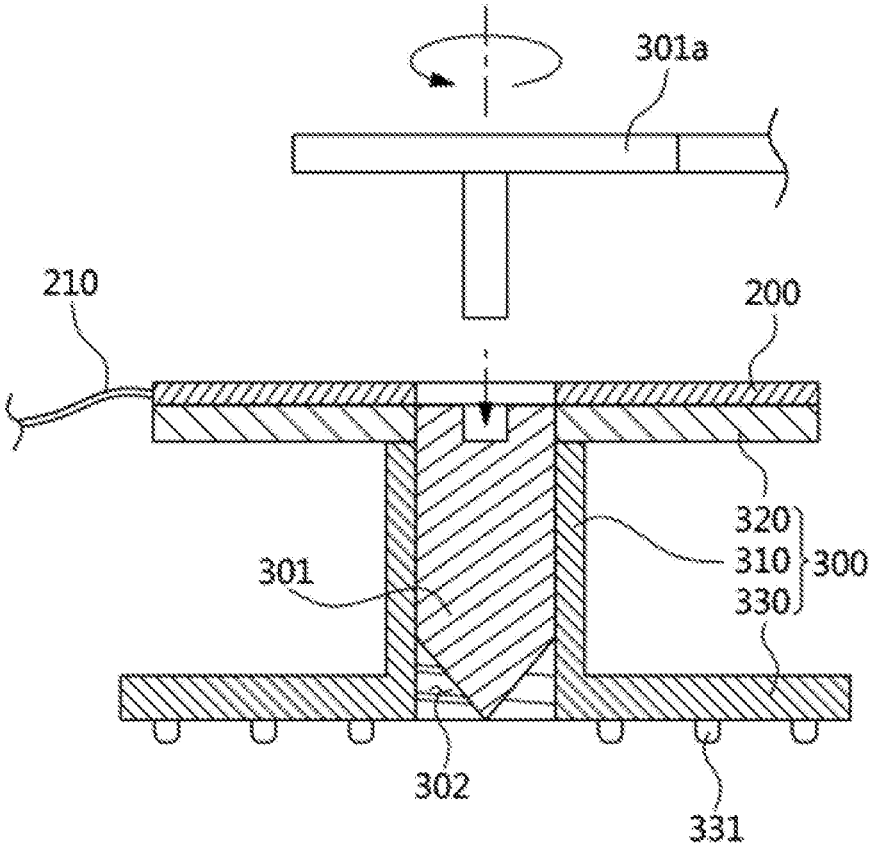
FIGS. 4 and 5 are sectional views showing the second embodiment of the electronic detonation device for a blasting system according to the present disclosure.
Figure 5:
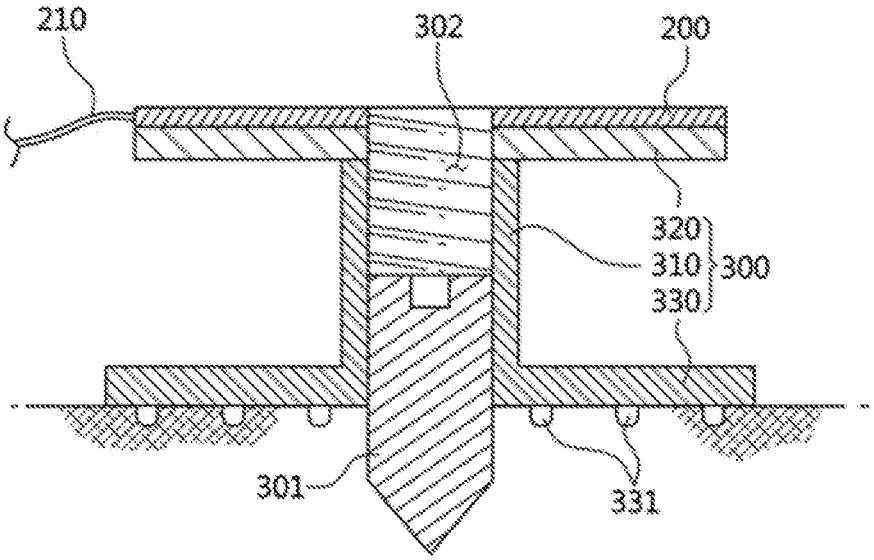
Figure 6:
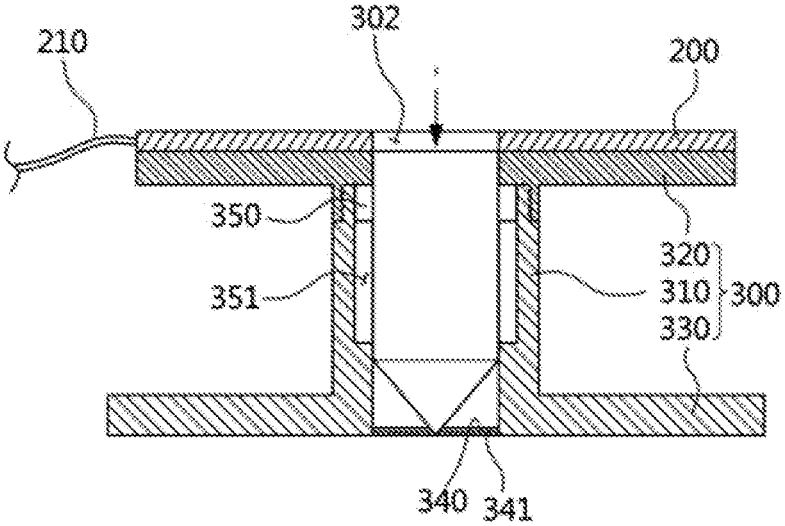
FIGS. 6 and 7 are sectional views showing a third embodiment of the electronic detonation device for a blasting system according to the present disclosure.
Figure 7:
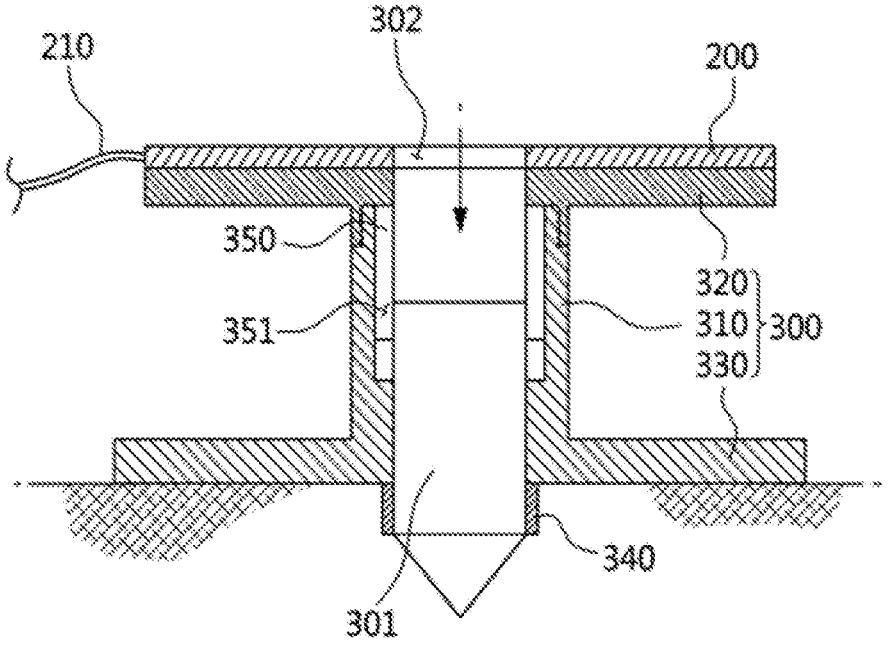

FIG. 3 is an exploded perspective view showing a second embodiment of the electronic detonation device for a blasting system according to the present disclosure. FIGS. 4 and 5 are sectional views showing the second embodiment of the electronic detonation device for a blasting system according to the present disclosure. FIGS. 6 and 7 are sectional views showing a third embodiment of the electronic detonation device for a blasting system according to the present disclosure.

Referring to FIG. 3, the pile part 301 is coupled into the wire-winding part 310 in a screwing manner as an example, and the pile part 301 has the pointed lower end so as to be easily driven into the ground.

When the screw-coupling of the pile part 301 is released from the wire-winding part 310 to separate the pile part 301 from the wire-winding part 310 and to drive the pile part 301 into the ground for fixation, the wireless communication module 200 positioned above the upper panel part 320 may be oriented in the vertical direction toward the sky. Referring to FIGS. 4 to 7, the communication module support 300 is provided with a hollow part 302 open at upper and lower ends thereof. Inside the hollow part 302, the pile part 301 is positioned to be movable vertically, so that the pile part 301 may selectively protrude through the lower portion of the communication module support 300 to be fixed in the ground.

Further, the wireless communication module 200 may be formed in a ring shape in which a void space is provided at the center communicating with the hollow part 302.

In detail, referring to FIGS. 4 and 5, the pile part 301, which is coupled to the inside of the hollow part 302 in the screwing manner, is rotated by a rotating device 301*a* and selectively protrudes through the lower portion of the communication module support 300. Thus, the pile part 301 may be fixed in the ground.

The hollow part 302 is open vertically, that is, open at the upper and lower ends thereof, and is positioned inside the wire-winding part 310, and the pile part 301 may be coupled to the inside of the hollow part 302 in the screwing manner and may be moved vertically depending on the direction of rotation thereof.

The pile part 301 has a first screw thread in an outer circumferential surface thereof, and the hollow part 302 is provided in an inner circumferential surface thereof with a second screw thread, which is engaged with the first screw thread in a screwing manner.

Through the screw-coupling between the first screw thread and the second screw thread in the hollow part 302, the pile part 301 is coupled to the communication module support 300, that is, the wire-winding part 310, in the screwing manner.

A device connection portion may be provided on the upper surface of the pile part 301, and may be connected to the rotating device 301*a*, which may rotate the pile part 301.

The device connection portion is formed in a groove as an example, and may be implemented in various shapes depending on the structure of the rotating device 301*a*.

The rotating device 301*a* may be a tool such as a screwdriver, a torque wrench, or the like, by which a worker can rotate the pile part 301 manually. Further, the rotating device 301*a* may be an electric rotating device 301*a* such as an electric torque wrench including a rotary motor.

The rotating device 301*a* may be implemented as any of various known structures, which may be coupled to the pile part 301 in a screw-coupled state and then rotate the pile part 301, so a detailed description thereof will be omitted.

The pile part 301 is coupled to the inside of the hollow part 302 in the screwing manner and is positioned inside the hollow part 302. Then, the pile part 301 descends by being rotated by the rotating device 301*a* to be driven into the ground, and is fixed in the state in which the communication module support 300 is oriented toward the sky.

The lower panel part 330 is seated on the ground, and serves to stably support the position of the wireless communication module 200.

The lower panel part 330 has an anti-rotation protrusion 331 on the lower surface thereof. The anti-rotation protrusion 331 is formed by protruding from the lower surface of the lower panel part 330 to prevent rotation of the pile part 301 when the pile part 301 is rotated by the rotating device 301*a*.

The anti-rotation protrusion 331 is positioned to protrude from the lower surface of the lower panel part 330, and is inserted or driven into the ground. Accordingly, when a rotation part (that is, the pile part), coupled to the inside of the hollow part 302 in the screwing manner, is rotated by the rotating device 301*a* and then is driven into the ground, the anti-rotation protrusion 331 may prevent the communication module support 300 from being rotated, and may allow the pile part 301 to be easily rotated and fixed in the ground.

Referring to FIGS. 6 and 7, the communication module support 300 has the hollow part 302 open at the upper and lower ends thereof. The hollow part 302 is provided with a pile-supporting plate 340 at the lower end thereof to support the lower end of the pile part 301. The pile part 301 is positioned inside the hollow part 302 to be vertically moveable, so that the pile part may be driven into the ground when a hitting device such as a hammer hits the pile part.

The pile-supporting plate 340 blocks the open lower end of the hollow part 302 to prevent downward separation of the pile part 301 from the hollow part 302 and to position the pile part 301 inside the hollow part 302.

The pile-supporting plate 340 has a plurality of cutting guide grooves 341, and the cutting guide grooves 341 are formed as partial cuts along straight lines, so that the pile-supporting plate 340 is easily torn when pressed by the pile part 301.

As an example, the cutting guide grooves 341 are formed in crisscross shapes, and may be formed in various shapes, which include a plurality of straight lines passing through the center of the pile-supporting plate 340, that is, the center of the hollow part 302.

The pile part 301 is provided on the outer circumferential surface thereof with a plurality of moving guide protrusions 350 formed to be spaced apart from each other in a circumferential direction, so that the pile part 301 descends straight by being guided by the moving guide protrusions 350. The hollow part 302 has moving guide rails 351 on the inner circumferential surface thereof, so that the moving guide protrusions 350 are inserted into the hollow part so as to be moveable along the moving guide rails, and the moving guide protrusions 350 descend by being guided by the moving guide rails 351.

The moving guide rails 351 are formed in vertically long-shaped slits so that the moving guide protrusions 350 are movably inserted therein. The slit-shaped moving guide rails 351 are arranged to be spaced apart from each other on the inner circumferential surface of the hollow part 302 in the circumferential direction thereof, and the moving guide rails 351 are positioned at positions corresponding to the moving guide protrusions 350.

Further, the moving guide rails 351 are blocked at upper ends thereof to limit the pile part 301 from being moved upwards from the hollow part 302.

When the pile part 301 is supported by the pile-supporting plate 340, the moving guide protrusions 350 are blocked by the closed upper ends of the moving guide rails 351, thus limiting the movement of the pile part 301.

The pile part 301 is limitedly movable only toward an open upper portion of the hollow part 302. Thus, the pile part 301 may be fixed inside the hollow part 302 without being removed through the open upper portion of the hollow part 302.

Further, the moving guide rail 351 is blocked at the lower end thereof to limit the downward protruding length of the pile part 301 and to prevent the pile part 301 from being removed downwards through a lower portion of the hollow part 302.

The pile part 301 is positioned such that the lower end thereof is supported by the pile-supporting plate 340 in the hollow part 302, and at an upper end thereof, the moving guide protrusions 350 are fixed by being blocked by the upper ends of the moving guide rail 351.

When a hitting device such as a hammer hits the pile part 301 at a position where the communication module support 300 is mounted, the pile part 301 descends while passing through the pile-supporting plate 340 and is then driven into the ground. Accordingly, the position of the communication module support 300 is fixed.

The communication module support 300 allows the pile part 301 to be fixed in the ground. The wireless communication module 200 positioned on the upper panel part 320 is oriented vertically toward the sky so as to secure improved communication performance.

Figure 8:
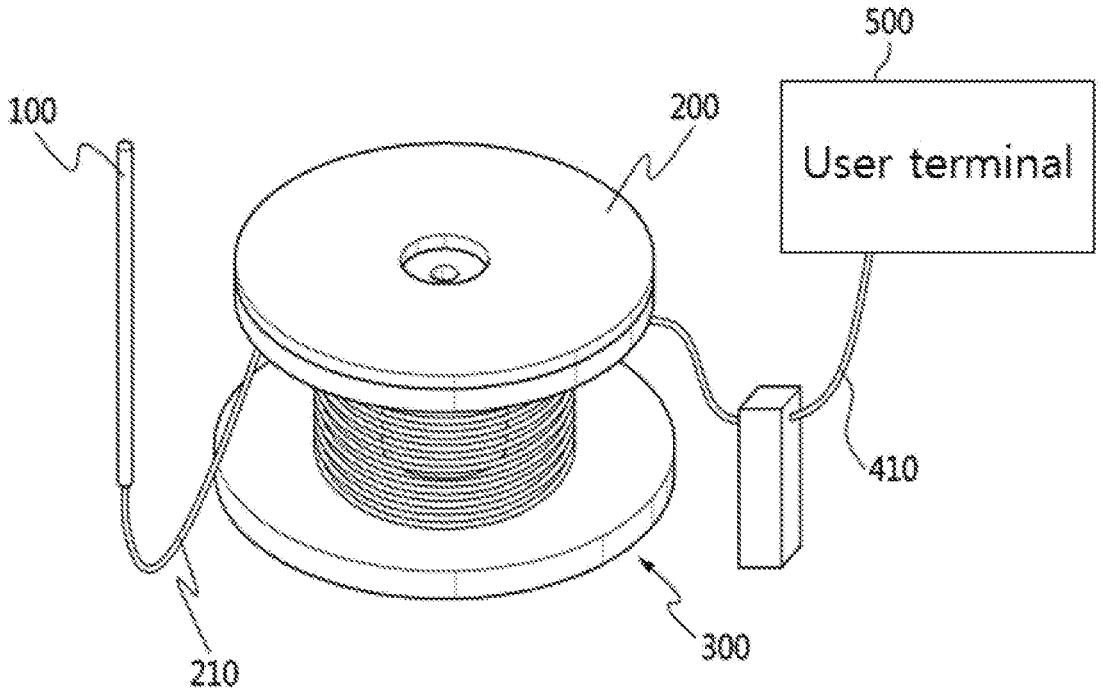
FIG. 8 is a schematic view showing the third embodiment of the electronic detonation device for a blasting system according to the present disclosure.

FIG. 8 is a schematic view showing the third embodiment of the electronic detonation device for a blasting system according to the present disclosure. Referring to FIG. 8, the electronic detonation device for a blasting system may include: a wired connector 400 enabling connection of the electric wire 210 to a user terminal 500; and a blast control wire 410 electrically connecting the wired connector 400 to the user terminal 500.

The wired connector 400 is electrically connected to the electric wire 210, and is selectively connected to the blast control wire 410, so that the electronic detonator 100 may be selectively connected to the user terminal 500 in a wired manner.

As an example, the blast control wire 410 has power-source jacks at opposite ends thereof, the power-source jacks being selectively coupled to the wired connector 400 and the user terminal 500 to establish an electrical connection between the wired connector 400 and the user terminal 500.

The power-source jacks may be realized in various forms of known power connection jacks such as a USB terminal, a DC power-source jack, and the like, so a detailed description thereof will be omitted.

That is, the electronic detonation device for a blasting system according to the present disclosure may be operated by communicating with the user terminal 500 through the wireless communication module 200. Alternately, the electronic detonation device for a blasting system may be operated by being electrically connected to the user terminal 500 in a wired manner using the wired connector 400.

Figure 9:
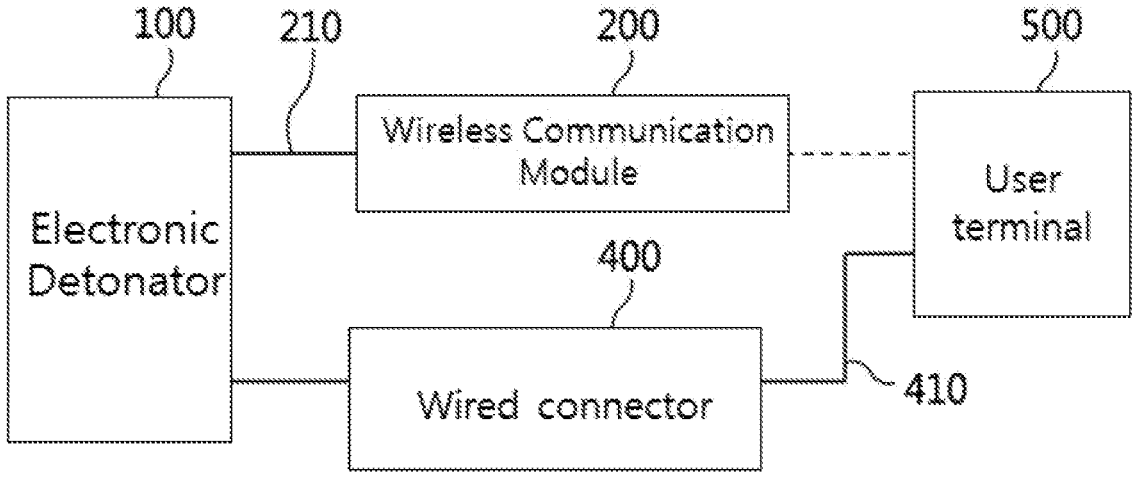
FIG. 9 is a block diagram showing a first embodiment of a blasting system using the electronic detonation device for a blasting system according to the present disclosure.

FIG. 9 is a block diagram showing a first embodiment of a blasting system using the electronic detonation device for a blasting system according to the present disclosure. Referring to FIG. 8, the blasting system according to the present disclosure may include: the electronic detonator 100; the wireless communication module 200; the electric wire 210 connecting the electronic detonator 100 and the wireless communication module 200; the commination module support 300 in which the electric wire 210 is stored in a wound state, with the wireless communication module 200 positioned on the upper surface of the communication module support 300; the user terminal 500 communicating wirelessly with the electronic detonator 100 through the wireless communication module 200 to control the operation of the electronic detonator 100; the wired connector 400 enabling connection of the electric wire 210 to the user terminal 500 in a wired manner; and the blast control wire 410 electrically connecting the wired connector 400 to the user terminal 500.

The communication module support 300 is provided with the pile part 301, which is configured to be fixed in the ground, and an embodiment thereof will be implemented as described above, so a redundant description thereof will be omitted.

The electronic detonator 100 communicates wirelessly with the user terminal 500 through the wireless communication module 200 so as to synchronize automatically with the user terminal 500.

The electronic detonator 100 communicates with the user terminal 500 using wired communication or wireless communication so as to receive detonation time information or to transmit identifier information and positioning information to the user terminal 500.

Detonator information may include detonation time information, blast delay time information, identifier information, and positioning information.

The electronic detonator 100 may receive a blast command from the user terminal 500 to explode an explosive. When the electronic detonator 100 starts to count a blast delay time included in the blast command, and the counting is completed, that is, after the blast delay time, the electronic detonator 100 detonates and explodes the explosive.

The wireless communication module 200 may allow the user terminal 500 and the electronic detonator 100 to communicate wirelessly with each other over a wireless network.

The wired connector 400 performs wired communication with the user terminal 500 using the blast control wire 410.

The wireless network, that is, known wireless networks such as mobile radio communication networks including long-term evolution (LTE), Bluetooth™, Wi-Fi, wireless broadband internet (WiBro), and long range network (LoRa), may be used to perform wireless communication.

The user terminal 500 may synchronize with the electronic detonator 100 to transmit detonation time information to the electronic detonator 100 or to receive the identifier information and the positioning information from the electronic detonator 100.

Further, the user terminal 500 may transmit respective blast commands including blast delay times to a plurality of the electronic detonators 100.

Figure 10:
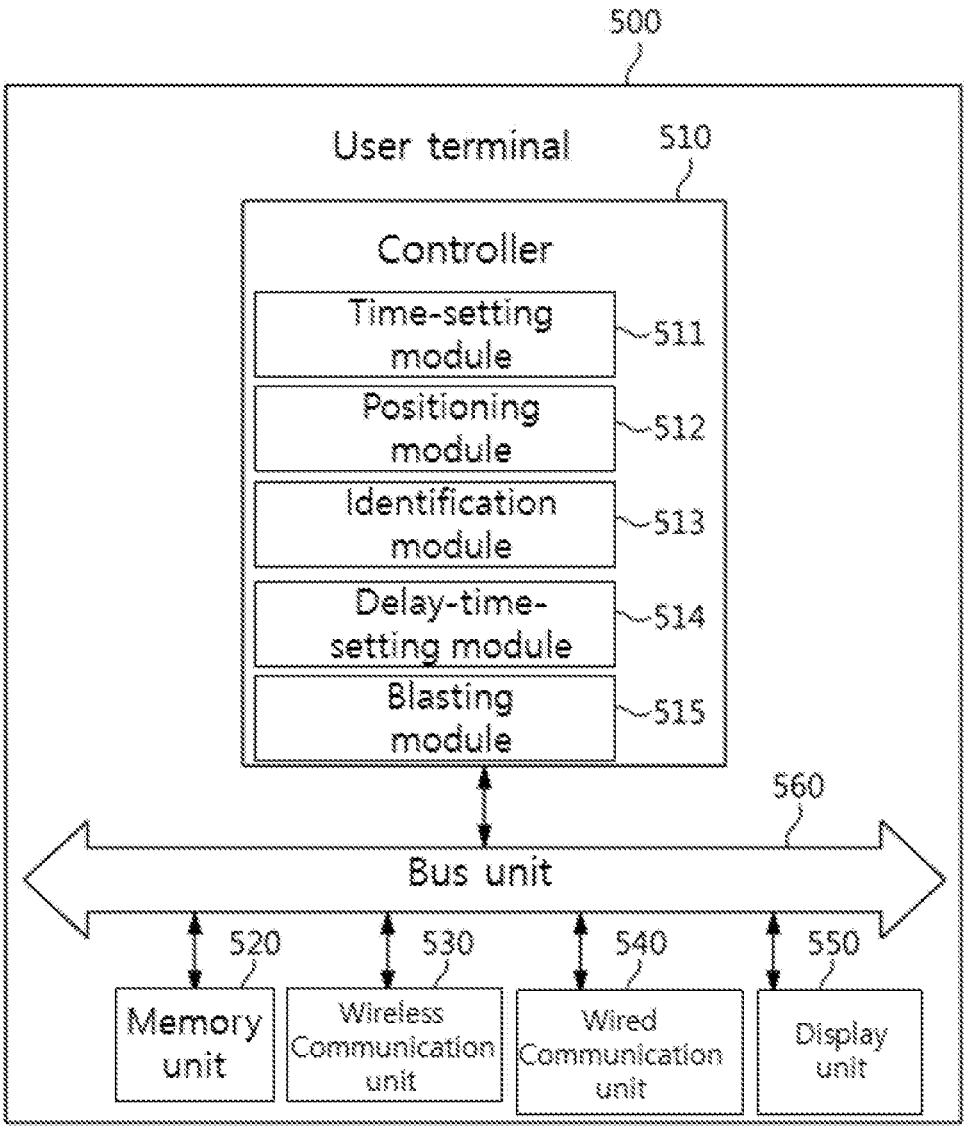
FIG. 10 is a block diagram showing a first embodiment of a user terminal of the blasting system using the electronic detonation device for a blasting system according to the present disclosure.

FIG. 10 is a block diagram showing a first embodiment of the user terminal 500 of the blasting system using the electronic detonation device for a blasting system according to the present disclosure.

Referring to FIGS. 8 to 10, the first embodiment of the user terminal 500 of the blasting system using the electronic detonation device for a blasting system will be described below in detail.

The user terminal 500 may include a controller 510, a memory unit 520, a wireless communication unit 530, a display unit 550, and a bus unit 560.

The controller 510 may control the overall operation of the user terminal 500. According to the embodiment, the controller 510 may be implemented as a central processing unit (CPU), a microprocessing unit (MPU), a graphics processing unit (GPU), or the like.

The memory unit 520 may store a plurality of commands constituting a program that may be executed by the controller 510, components list data for a components list, and components property data indicating properties of components. Depending on the embodiment, the memory unit 520 may be implemented as read-only memory (ROM), random access memory (RAM), a hard disk drive (HDD), a solid-state drive (SSD), or the like.

The wireless communication unit 530 may perform communication between the user terminal 500 and the electronic detonator 100. For example, the wireless communication unit 530 may communicate with the wireless communication module 200 over a wireless network. According to the embodiment, the wireless communication unit 530 may use various types of wireless networks, such as mobile radio communication networks including long-term evolution (LTE), Bluetooth™, Wi-Fi, wireless broadband internet (WiBro), long range network (LoRa), etc., to perform communication.

A wired communication unit 540 may support wired communication between the user terminal 500 and the electronic detonator 100. For example, the wired communication unit 540 may be connected to the electronic detonator 100 through a separate line, that is, the blast control wire 410 and the wired connector 400, thereby enabling communication with the electronic detonator 100. According to the embodiment, the wired communication unit 540 may use various types of wired networks such as a local area network (LAN), a wide area network (WAN), and the like so as to perform communication.

The display unit 550 may display an image. For example, the display unit 550 may be implemented as a display panel. According to the embodiment, the display unit 550 may be implemented as any one of a liquid crystal display device), an organic light-emitting display device, and the like. However, the present disclosure is not limited thereto, and the display unit 550 may be implemented as any of various devices as long as the display unit 550 serves the purpose of displaying an image. The display unit 550 may display the electronic detonator 100 on a map on the basis of the identifier information and the positioning information received from the electronic detonator 100.

The bus unit 560 may perform data transmission and reception between the controller 510, the memory unit 520, the wireless communication unit 530, the wired communication unit 540, and the display unit 550. Depending on the embodiment, the bus unit 560 may be implemented as a bus interface.

The controller 510 may include a time-setting module 511, the positioning module 512, the identification module 513, a delay-time-setting module 514, and the blasting module 515. In the specification, a module may be software (a program) in which the commands constituting the program stored in the memory unit 520 are executed by the controller 510.

The time-setting module 511 may set the detonation time corresponding to the electronic detonator 100.

When the user terminal 500 is synchronized with the electronic detonator 100, the time-setting module 511 may set the detonation time and transmit the detonation time information indicating the detonation time to the electronic detonator 100 through the wireless communication unit 530 and the wired communication unit 540.

The positioning module 512 may check the position of the electronic detonator 100. When the user terminal 500 is synchronized with the electronic detonator 100, the positioning module 512 may receive the positioning information from the electronic detonator 100 through the wireless communication unit 530 and the wired communication unit 540. Further, the positioning module 512 may check the position of the electronic detonator 100 using the positioning information.

The identification module 513 may detect an identifier by receiving the identifier information of the electronic detonator 100. When the user terminal 500 is synchronized with the electronic detonator 100, the identification module 513 may receive the identifier information from the electronic detonator 100 through the wireless communication unit 530 or the wired communication unit 540. Further, the identification module 513 may identify the electronic detonator 100 using the identifier information.

The delay-time-setting module 514 may set the blast delay time corresponding to the electronic detonator 100. For example, the blast delay time may be set in consideration of a delay time and a stepped difference. When the user terminal 500 is synchronized with the electronic detonator 100, the delay-time-setting module 514 may set the blast delay time.

The blasting module 515 may transmit a blast command to the electronic detonator 100, the blast command including the blast delay time set by the delay-time-setting module 514. For example, the blasting module 515 may transmit the blast command to the electronic detonator 100 through the wireless communication unit 530 and the wired communication unit 540. The electronic detonator 100 may store the blast delay time information indicating the blasting delay time included in the received blast command.

Figure 11:
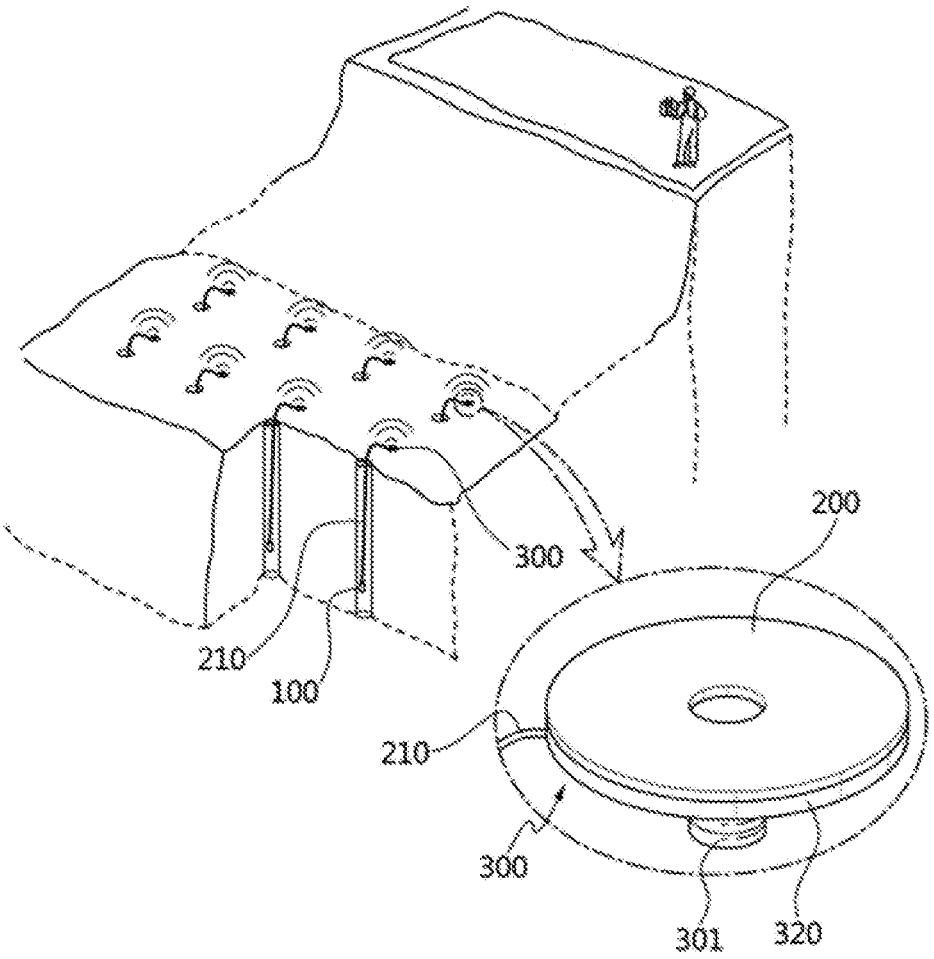
FIG. 11 is a schematic view showing a usage example of the electronic detonation device for a blasting system according to the present disclosure.

FIG. 11 is a schematic view showing a usage example of the electronic detonation device for a blasting system according to the present disclosure.

Referring to FIG. 11, the blasting system using the electronic detonation device for a blasting system according to the present disclosure is configured to insert the electronic detonator 100 into a blasting hole provided in the ground and then to blast the electronic detonator 100 by communicating with the user terminal via wireless communication or wired communication.

The communication module support 300 is vertically oriented toward the sky by driving the pile part 301 into the ground, so that the wireless communication module 200 secures communication stability.

The present disclosure is configured to secure stable communication reliability by orienting the wireless communication module toward the sky, so that malfunction during blasting can be prevented and blasting accuracy can be improved.

The present disclosure is configured to communicate with the user terminal 500 by selectively using wireless communication or wired communication so that work convenience can be improved and operating costs can be reduced.

The present disclosure is not limited to the above-described embodiments, and may be implemented as various modifications, additions and substitutions without departing from the scope and spirit of the present disclosure as disclosed in the accompanying claims, and the modifications and the like are included in the configuration of the present disclosure.

The invention claimed is:

1. An electronic detonation device for a blasting system, the electronic detonation device comprising:

an electronic detonator;

a wireless communication module;

an electric wire connecting the electronic detonator to the wireless communication module; and a communication module support in which the electric wire is stored in a wound state, with the wireless communication module positioned on an upper surface of the communication module support, wherein the communication module support is provided with a pile part configured to be driven into a ground for fixation, wherein the communication module support comprises:

a wire-winding part on which the electric wire is wound;

an upper panel part positioned above the wire-winding part, and on which the wireless communication module is positioned; and a lower panel part positioned under the wire-winding part, wherein the upper panel part is provided with the pile part protruding downwards from a lower surface thereof, and the pile part is positioned to be removably coupled to the wire-winding part.

2. The electronic detonation device of claim 1, wherein the pile part is forcibly fitted into the wire-winding part.

3. The electronic detonation device of claim 1, wherein the pile part is coupled into the wire-winding part in a screwing manner.

4. The electronic detonation device of claim 1, wherein the pile part is inserted into the wire-winding part, and is fixed while being coupled to the wire-winding part such that an outer circumferential surface of the pile part is pressed by a set screw tightened to the wire-winding part.

5. The electronic detonation device of claim 1, further comprising:

a wired connector connecting the electric wire to a user terminal in a wired manner; and a blast control wire electrically connecting the wired connector to the user terminal.

6. An electronic detonation device for a blasting system, the electronic detonation device comprising:

an electronic detonator;

a wireless communication module;

an electric wire connecting the electronic detonator to the wireless communication module; and a communication module support in which the electric wire is stored in a wound state, with the wireless communication module positioned on an upper surface of the communication module support, wherein the communication module support is provided with a pile part configured to be driven into a ground for fixation, wherein the communication module support has a hollow part open at upper and lower ends thereof, and the pile part is positioned inside the hollow part to be moveable upwards and downwards so that the pile part selectively protrudes through a lower portion of the communication module support and is then fixed into the ground.

7. The electronic detonation device of claim 6, wherein the pile part is positioned inside the hollow part in a screwing manner, and is rotated by a rotating device so as to selectively protrude through the lower portion of the communication module support and to be driven into the ground.

8. The electronic detonation device of claim 6, wherein the communication module support comprises:

a wire-winding part on which the electric wire is wound;

an upper panel part positioned above the wire-winding part, and on which the wireless communication module is positioned; and a lower panel part positioned under the wire-winding part, wherein the wire-winding part has a hollow part open at upper and lower ends thereof, the pile part is coupled into the hollow part in a screwing manner and is moved upwards and downwards depending on a direction of rotation thereof, and a lower surface of the lower panel has an anti-rotation protrusion preventing rotation thereof when the pile part is rotated by a rotating device.

9. The electronic detonation device of claim 6, wherein the communication module support has the hollow part open at the upper and lower ends thereof, the hollow part is provided with a pile-supporting plate at a lower end thereof to support a lower end of the pile part, and the pile part is moveable inside the hollow part and is driven into the ground when a hitting device hits the pile part.

10. The electronic detonation device of claim 9, wherein the pile-supporting plate has a plurality of cutting guide grooves therein, each of the cutting guide grooves being formed as a partial cut along a straight line, so that the pile-supporting plate is torn when being pressed by the pile part.

11. The electronic detonation device of claim 9, wherein the pile part is provided on an outer circumferential surface thereof with a plurality of moving guide protrusions formed to be spaced apart from each other in a circumferential direction thereof, so that the pile part descends straight by being guided by the moving guide protrusions, and the hollow part has moving guide rails on an inner circumferential surface thereof, so that the moving guide protrusions are inserted into the hollow part to be moveable along the moving guide rails and descend by being guided by the moving guide rails.

12. The electronic detonation device of claim 11, wherein the moving guide rails are blocked at upper ends thereof to limit the pile part from being moved upwards from the hollow part, and the moving guide rails are blocked at lower ends thereof to limit a downward protruding length of the pile part and to prevent the pile part from being removed downwards from the hollow part when the hitting device hits the pile part.

* * * * *